US009976519B2

(12) United States Patent
Tseng et al.

(10) Patent No.: US 9,976,519 B2
(45) Date of Patent: May 22, 2018

(54) CONFIDENCE-MODIFIED EXPONENTIALLY WEIGHTED MOVING AVERAGE FILTER FOR ENGINE-OFF NATURAL VACUUM TESTING

(71) Applicant: Ford Global Technologies, LLC, Dearborn, MI (US)

(72) Inventors: Fling Finn Tseng, Ann Arbor, MI (US); Aed M. Dudar, Canton, MI (US); Imad Hassan Makki, Dearborn Heights, MI (US); Robert Roy Jentz, Westland, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 22 days.

(21) Appl. No.: 14/922,641

(22) Filed: Oct. 26, 2015

(65) Prior Publication Data

US 2017/0114755 A1 Apr. 27, 2017

(51) Int. Cl.
*F02M 25/08* (2006.01)

(52) U.S. Cl.
CPC ..... *F02M 25/0809* (2013.01)

(58) Field of Classification Search
CPC .. F02D 41/04; F02D 41/0025; F02M 25/0809
See application file for complete search history.

(56) References Cited

U.S. PATENT DOCUMENTS 5,559,285 A 9/1996 Bryant et al.
6,889,215 B2 5/2005 Basir et al.
7,293,400 B2 11/2007 Taware et al.
7,840,298 B2 11/2010 Malig et al.
8,074,627 B2 12/2011 Siddiqui
8,734,126 B2 5/2014 Nishimura et al.
2002/0046609 A1* 4/2002 Ito ..... F02M 25/0809 73/700
2002/0116102 A1* 8/2002 Kaiser ..... F02M 25/0809 701/33.8

(Continued)

FOREIGN PATENT DOCUMENTS

EP 2187223 B1 1/2014

OTHER PUBLICATIONS

Dudar, Aed M. et al., "Systems and Methods for Engine-Off Natural Vacuum Leak Testing With Fuel Enablement Compensation," U.S. Appl. No. 14/799,783, filed Jul. 15, 2015, 42 pages.

*Primary Examiner* — Joseph Dallo
*Assistant Examiner* — Kurt Liethen
(74) *Attorney, Agent, or Firm* — Julia Voutyras; McCoy Russell LLP

(57) ABSTRACT

Methods and systems are provided for conducting an engine-off natural vacuum test and filtering the output of the engine-off natural vacuum (EONV) test based on a variable weighting factor. In one example, one or more EONV test entry conditions are evaluated with one or more membership functions corresponding to the indicated result of the EONV test to obtain an overall confidence value that is used to modify the weighting factor. In this way, the filtered EONV output reflects the confidence in the test results, and as such a malfunction indicator light may be more appropriately set as compared to conditions wherein filtered EONV output is not based on confidence in the test results.

19 Claims, 5 Drawing Sheets

(56) References Cited

U.S. PATENT DOCUMENTS

| | | | | |
|---|---|---|---|---|
| 2006/0053868 | A1* | 3/2006 | Chung | B60K 6/44 73/49.7 |
| 2007/0137622 | A1* | 6/2007 | Koyama | F02D 41/0045 123/520 |
| 2010/0224171 | A1* | 9/2010 | Peters | F02M 25/0836 123/520 |
| 2012/0211087 | A1* | 8/2012 | Dudar | F02D 41/0032 137/12 |
| 2013/0112176 | A1* | 5/2013 | Peters | F02M 25/0809 123/521 |
| 2014/0122020 | A1* | 5/2014 | Kowalkowski | G06F 17/18 702/179 |
| 2015/0114089 | A1* | 4/2015 | Dudar | F02M 25/0809 73/40 |
| 2016/0025589 | A1* | 1/2016 | Tseng | F02M 25/0809 73/40.5 R |

* cited by examiner

CONFIDENCE-MODIFIED EXPONENTIALLY WEIGHTED MOVING AVERAGE FILTER FOR ENGINE-OFF NATURAL VACUUM TESTING

FIELD

The present description relates generally to methods and systems for controlling a vehicle engine to indicate undesired evaporative emissions based on a confidence level in the outcome of an engine-off natural vacuum test.

BACKGROUND/SUMMARY

Vehicle emission control systems may be configured to store fuel vapors from fuel tank refueling and diurnal engine operations, and then purge the stored vapors during a subsequent engine operation. In an effort to meet stringent federal emissions regulations, emission control systems may need to be intermittently diagnosed for the presence of undesired vapor emissions that could release fuel vapors to the atmosphere. Undesired vapor emissions may be identified using engine-off natural vacuum (EONV) during conditions when a vehicle engine is not operating. In particular, a fuel system may be isolated at an engine-off event. The pressure in such a fuel system may increase if the tank is heated further (e.g., from hot exhaust or a hot parking surface) as liquid fuel vaporizes. A pressure rise above a threshold may indicate the absence of undesired fuel system vapor emissions. Alternatively, in the absence of a pressure rise above a threshold, as a fuel system cools down, a vacuum is generated therein as fuel vapors condense to liquid fuel. Vacuum generation may monitored and undesired fuel system vapor emissions identified based on expected vacuum development or expected rates of vacuum development.

Entry conditions and thresholds for an EONV test may be based on an inferred total amount of heat rejected into the fuel tank during the prior drive cycle. The inferred amount of heat may be based on engine run-time, integrated mass air flow, fuel level, ambient temperature, reid vapor pressure, etc. While these heat rejection inferences work well in most conditions, they may be prone to errors when noise factors are involved. For example, if a vehicle is driven downhill for an extended period, driven under rainy and/or windy conditions, or under conditions where a period of high-speed driving is followed by a period of idling, much of the heat rejection to the fuel tank may be negated. As a result, an EONV test executed based on a heat rejection inference where the above described noise factors are involved may result in a false failure.

As a safeguard to potential error in EONV test results, the California Air Resources Board (CARB) allows original equipment manufacturers (OEMs) to use an Exponentially Weighted Moving Average (EWMA) to set a malfunction indicator light (MIL). EWMA filtering is a data processing technique used to calculate a filtered value based on raw data points collected from an incoming stream of data, for example data resulting from a number of EONV tests. In the event that the calculated filtered value determined by the EWMA filter exceeds a threshold, a diagnostic trouble code (DTC) may be set to a fail status, and a MIL may be illuminated to indicate the fault. As an example, the normal EWMA (NORM) filter in use is a heavily filtered channel that is enabled after a fourth EONV test. Per CARB's requirements, it will illuminate a MIL in one trip, wherein using the recommended filter constant will produce filtering comparable to a five-test average. Use of this normal filter screens out minor EONV failures associated with the noise factors described above.

However, results from EONV tests all go through EWMA filtering with constant rates not considering the degree of compliance to entry conditions. This is because the final outcome of evaluation of a set of entry conditions results in either enabling an EONV test, or prohibiting the EONV test from executing. For example, if one or more entry conditions do not pass a threshold, the EONV test execution may be prohibited. On the other hand, if all entry conditions pass a threshold, the EONV test may be enabled. As such, upon completion of an EONV test, the EWMA filtered result may in fact be quite misleading because the confidence for each EONV test run is not constant, yet the results are all treated with equal weighting through EWMA filtering. For example, if one or more entry conditions are very near their thresholds, an EONV test may execute, yet the degree of confidence in the result may be less than the degree of confidence for an EONV test where the same entry conditions are substantially above their thresholds.

An alternative to equally weighting an EWMA filter is to make the weighting variable to reflect a confidence level in the EONV test results. A method for increasing a weighting factor of an EWMA filter is disclosed in U.S. Patent Application Publication No. 2014/0122020 A1. Therein, the method includes increasing the weighting factor of the EWMA filter to more heavily weigh incoming raw data values of the data stream. However, the inventors herein have recognized that while teaching adjusting the weighting factor of an EWMA filter, such a method does not teach adjusting the weighting factor based on a level of confidence in an obtained test result.

The inventors herein have recognized the above issues, and have developed systems and methods to at least partially address them. In one example, a method is provided comprising, inducting vapors from a fuel system into an engine which propels a motor vehicle, and, responsive to an engine shut-down event, evaluating one or more EONV test entry conditions with fuzzy membership functions and/or calibratable tables corresponding to predicted outcomes of an EONV test, the predicted outcomes comprising, for example, undesired vapor emissions and the absence of undesired vapor emissions. Entry conditions may be based on an inferred total amount of heat rejected into a fuel tank during a previous drive cycle, and the inferred amount of heat may be based on one or more of the following: engine run-time, integrated mass air flow, fuel level, ambient temperature, reid vapor pressure, etc. For each entry condition, a maximum confidence value, or degree of confidence, for each predicted outcome may be determined, and then a maximum temporary overall confidence value may further be determined based on all individual maximum confidence values. In one example, the method may include generating a degree of confidence for each of a plurality of test entry conditions that a test for undesired vapor emissions will achieve a reliable result, and commencing the test based on a temporary confidence value related to the degree of confidences. In this way, an optimistic interpretation of entry conditions may be used to enable entry into the EONV evaporative emissions test such that the test executes frequently.

As one example, subsequent to the generation of an EONV test result based on pressure of the fuel system during the test, a second set of confidence values, or degree of confidences, may be obtained based on the fuzzy membership function and/or calibratable table for each individual entry condition corresponding to the EONV test result, and then a final overall confidence value may be further determined based on all second individual confidence values. In one example, the final overall confidence value may be an average of the individual confidence values. The final overall confidence value may then be used to modify a weighting factor for an EWMA filter. Thus, rather than equally weighting the EWMA filter, the weighting is made variable such that the output reflects the level of confidence in the EONV test results. As such, higher confidence results may be more heavily weighted than those results with lower confidence. In this way, the setting of a MIL when undesired emissions are indicated but the confidence level in the test results are low, may be reduced. Additionally, the early setting of a MIL when undesired emissions are indicated with high confidence, may contribute to a reduction in undesired evaporative emissions.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2A:
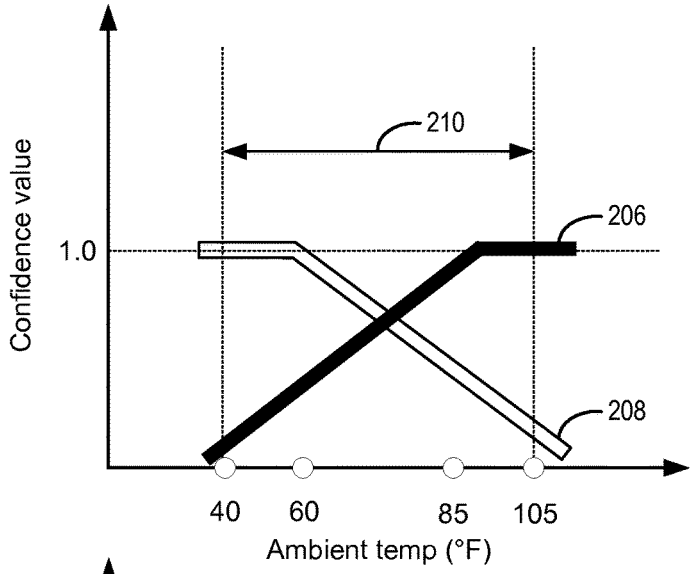
FIGS. 2A-2C illustrate example entry conditions for EONV evaporative emissions test where membership functions define "undesired vapor emissions" and "absence of undesired vapor emissions" conditions.
Figure 2B:
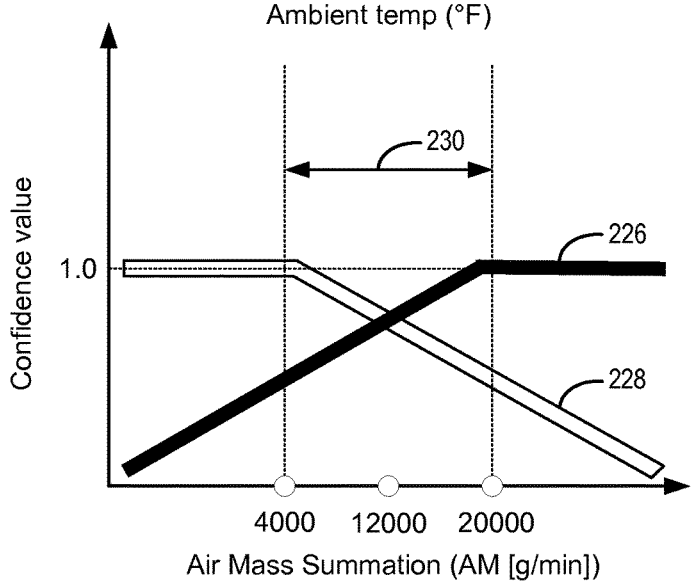
Figure 2C:
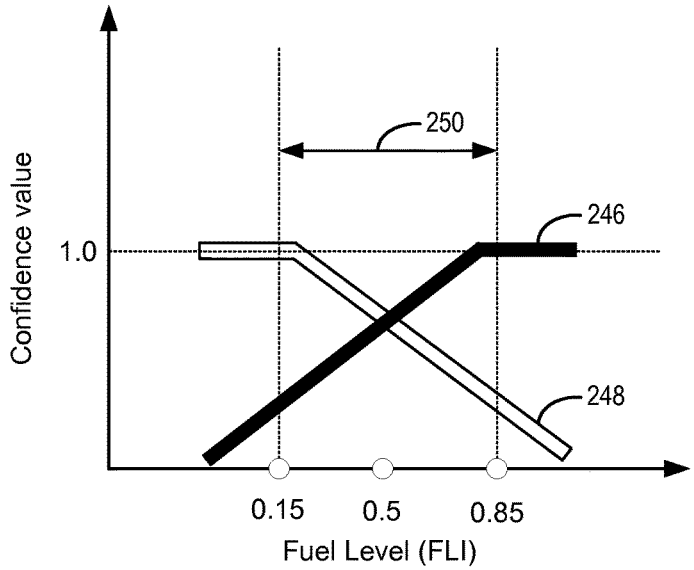
Figure 3:
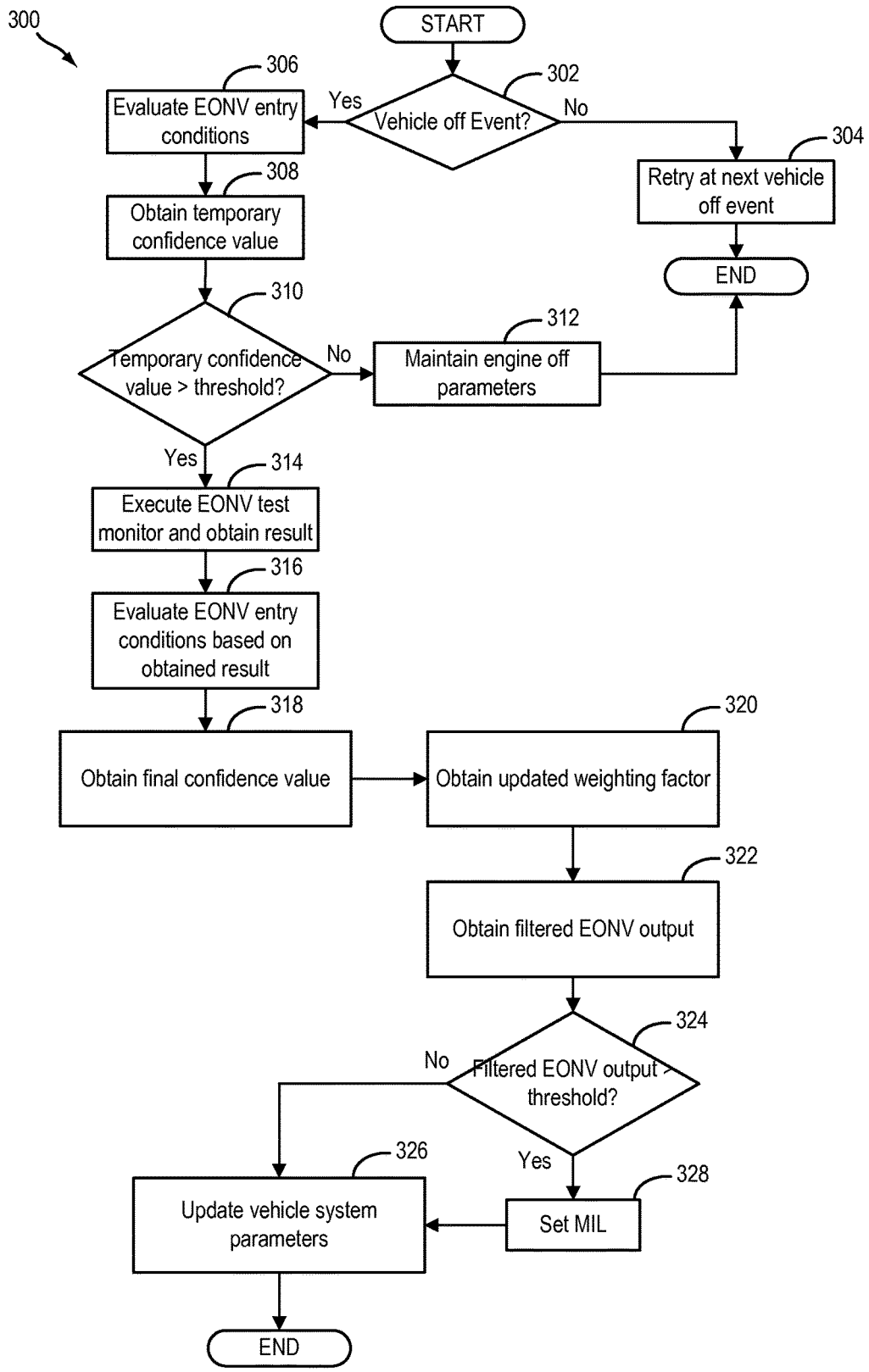
FIG. 3 shows a flow-chart for a high level method for an EONV evaporative emissions test where EONV output is filtered based on confidence in the obtained EONV test result.
Figure 4:
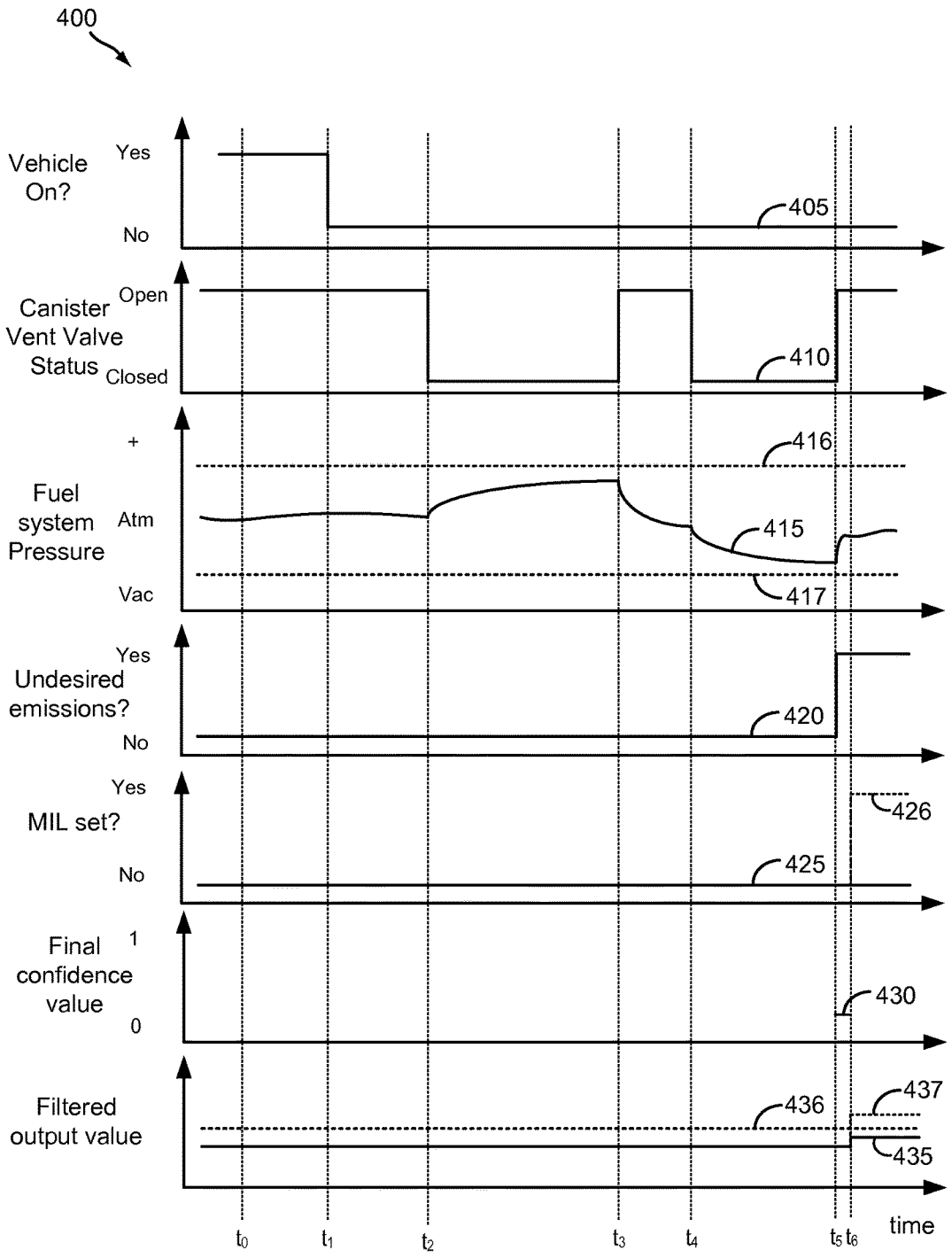
FIG. 4 shows an example timeline for an EONV evaporative emissions test where a malfunction indicator light is correctly not set based on filtered EONV output.
Figure 5:
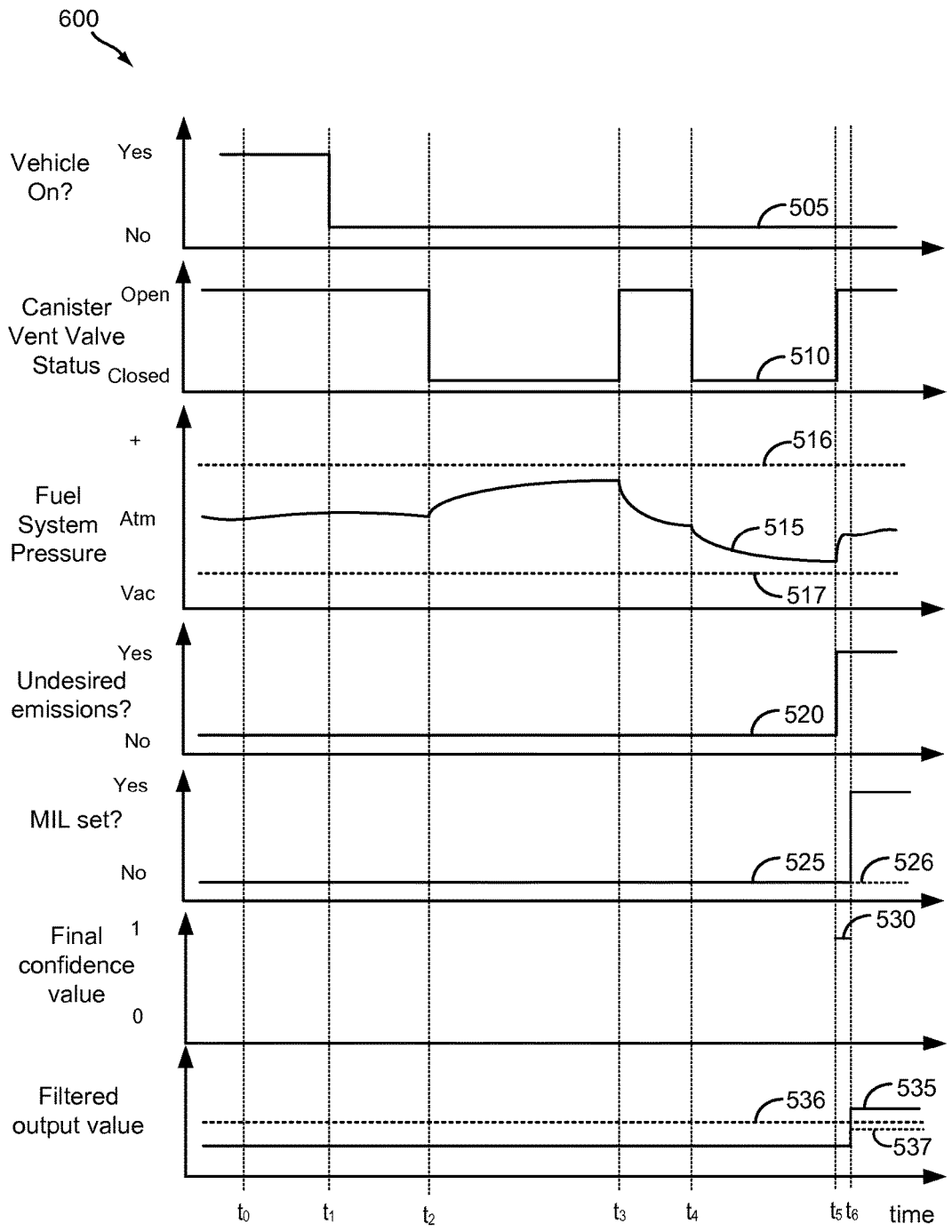
FIG. 5 shows an example timeline for an EONV evaporative emissions test where a MIL is correctly set based on filtered EONV output.

The detailed description relates to systems and methods for inducting vapors from a fuel system into an engine, and conducting an onboard engine off natural vacuum (EONV) test for undesired vapor emissions from the tank after the vapor inducting is stopped. More specifically, the description relates to enabling entry into an onboard evaporative emissions test procedure based on a maximum temporary confidence factor obtained from the evaluation of one or more entry conditions, and further includes filtering the results of the EONV test based on a final confidence level in the obtained EONV test result. The evaporative emissions test may be conducted on the vehicle system depicted in FIG. 1. Following a drive cycle, one or more entry conditions for EONV evaporative emissions testing may be evaluated using one or more fuzzy membership functions and/or calibratable tables corresponding to potential EONV test outcomes in order to determine a maximum temporary confidence factor for enabling entry into the EONV test, as illustrated in FIGS. 2A-2C. Upon successful completion of the EONV test, the entry conditions may be again evaluated with the membership function or table corresponding to the actual results of the test such that a filtered EONV output may be determined based on a final confidence level in the EONV test result. The filtered EONV output may be compared to a predetermined threshold wherein a malfunction indicator light (MIL) may be set if the filtered EONV output is above the threshold. A method for an EONV test that enables entry into the EONV test procedure based on a temporary confidence factor, and where a final confidence factor based on the EONV test result is used for obtaining filtered EONV output for determining whether to set a MIL is illustrated in FIG. 3. A timeline for an EONV test where a MIL is correctly not set based on filtered EONV output is shown in FIG. 4, and a timeline for an EONV test where a MIL is correctly set based on filtered EONV output is shown in FIG. 5.

Figure 1:
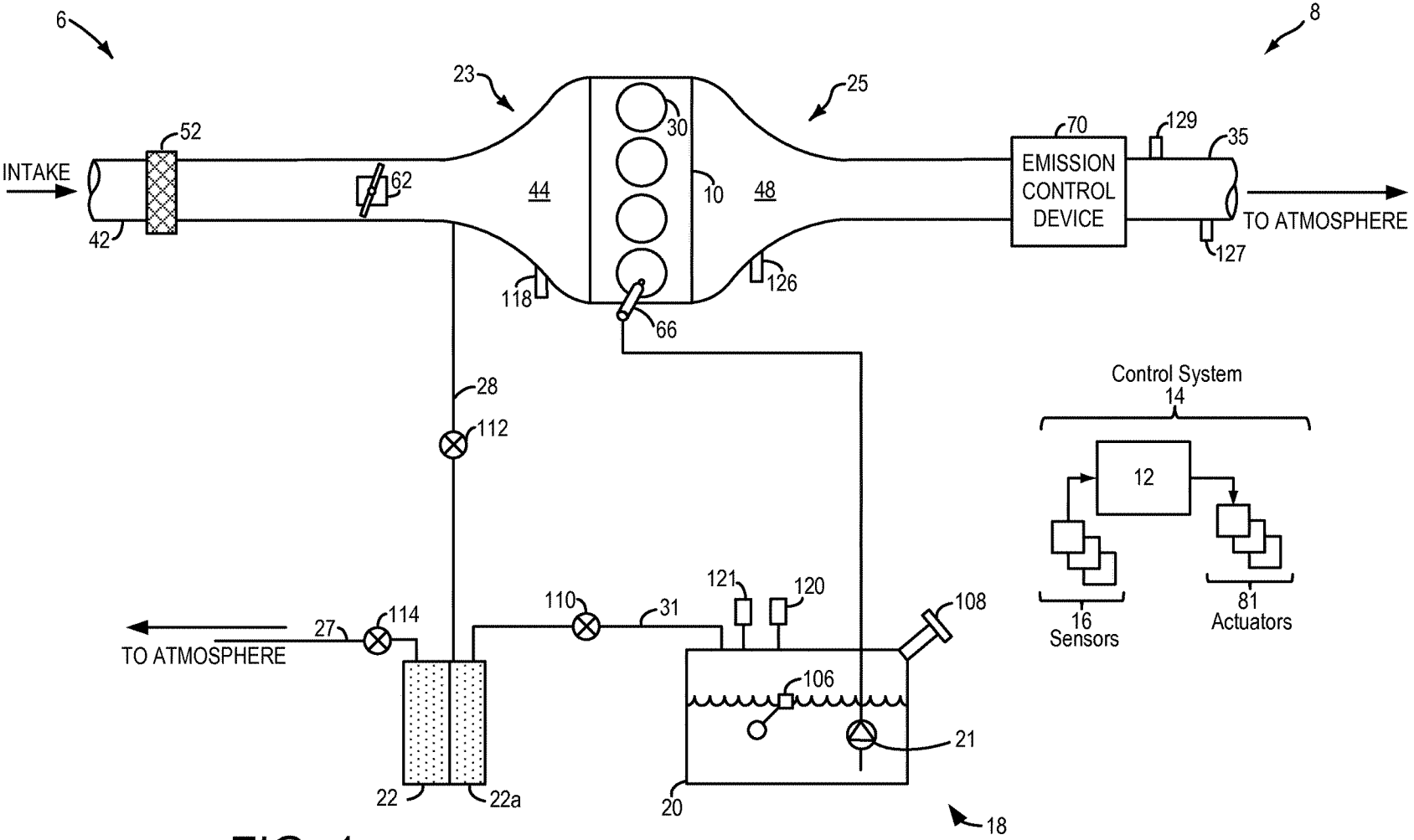
FIG. 1 schematically shows a fuel system and an emissions system for an example vehicle engine.

FIG. 1 shows a schematic depiction of a hybrid vehicle system 6 that can derive propulsion power from engine system 8 and/or an on-board energy storage device, such as a battery system (not shown). An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to a fuel system 18. Fuel system 18 includes a fuel tank 20 coupled to a fuel pump 21 and a fuel vapor canister 22. During a fuel tank refueling event, fuel may be pumped into the vehicle from an external source through refueling port 108. Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 10, such as example injector 66. While a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, via conduit 31, before being purged to the engine intake 23.

Fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 by opening canister purge valve 112. While a single canister 22 is shown, it will be appreciated that fuel system 18 may include any number of canisters. In one example, canister purge valve 112 may be a solenoid valve wherein opening or closing of the valve is performed via actuation of a canister purge solenoid.

Canister 22 may include a buffer 22*a* (or buffer region), each of the canister and the buffer comprising the adsorbent. As shown, the volume of buffer 22*a* may be smaller than (e.g., a fraction of) the volume of canister 22. The adsorbent in the buffer 22*a* may be same as, or different from, the adsorbent in the canister (e.g., both may include charcoal). Buffer 22*a* may be positioned within canister 22 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

Canister 22 includes a vent 27 for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. In one example, canister vent valve 114 may be a solenoid valve wherein opening or closing of the valve is performed via actuation of a canister vent solenoid. In particular, the canister vent valve may be an open that is closed upon actuation of the canister vent solenoid. In some examples, an air filter may be coupled in vent 27 between canister vent valve 114 and atmosphere.

As such, hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, a fuel tank isolation valve 110 may be optionally included in conduit 31 such that fuel tank 20 is coupled to canister 22 via the valve. During regular engine operation, isolation valve 110 may be kept closed to limit the amount of diurnal or "running loss" vapors directed to canister 22 from fuel tank 20. During refueling operations, and selected purging conditions, isolation valve 110 may be temporarily opened, e.g., for a duration, to direct fuel vapors from the fuel tank 20 to canister 22. By opening the valve during purging conditions when the fuel tank pressure is higher than a threshold (e.g., above a mechanical pressure limit of the fuel tank 10), the refueling vapors may be released into the canister and the fuel tank pressure may be maintained below pressure limits. While the depicted example shows isolation valve 110 positioned along conduit 31, in alternate embodiments, the isolation valve may be mounted on fuel tank 20. The fuel system may be considered to be sealed when isolation valve 110 is closed. In embodiments where the fuel system does not include isolation valve 110, the fuel system may be considered sealed when purge valve 112 and canister vent valve 114 are both closed.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 directly coupled to fuel tank 20, in alternate embodiments, the pressure sensor may be coupled between the fuel tank and canister 22, specifically between the fuel tank and isolation valve 110. In still other embodiments, a first pressure sensor may be positioned upstream of the isolation valve (between the isolation valve and the canister) while a second pressure sensor is positioned downstream of the isolation valve (between the isolation valve and the fuel tank), to provide an estimate of a pressure difference across the valve. In some examples, a vehicle control system may infer and indicate undesired fuel system vapor emissions based on changes in a fuel tank pressure during an evaporative emissions diagnostic routine.

One or more temperature sensors 121 may also be coupled to fuel system 18 for providing an estimate of a fuel system temperature. In one example, the fuel system temperature is a fuel tank temperature, wherein temperature sensor 121 is a fuel tank temperature sensor coupled to fuel tank 20 for estimating a fuel tank temperature. While the depicted example shows temperature sensor 121 directly coupled to fuel tank 20, in alternate embodiments, the temperature sensor may be coupled between the fuel tank and canister 22.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) or manifold vacuum (ManVac) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode (e.g., during a fuel tank refueling operation and with the engine not running), wherein the controller 12 may open isolation valve 110 and canister vent valve 114 while closing canister purge valve (CPV) 112 to direct refueling vapors into canister 22 while preventing fuel vapors from being directed into the intake manifold.

As another example, the fuel system may be operated in a refueling mode (e.g., when fuel tank refueling is requested by a vehicle operator), wherein the controller 12 may open isolation valve 110 and canister vent valve 114, while maintaining canister purge valve 112 closed, to depressurize the fuel tank before allowing enabling fuel to be added therein. As such, isolation valve 110 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 12 may open canister purge valve 112 and canister vent valve while closing isolation valve 110. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include heated exhaust gas oxygen sensor (HEGO) 126 located upstream of the emission control device, catalyst monitor sensor (CMS) 127 located downstream of the emission control device, MAP sensor 118, pressure sensor 120, and pressure sensor 129. Other sensors such as additional pressure, temperature, air/fuel ratio, and composition sensors may be coupled to various locations in the vehicle system 6. For example, ambient temperature and pressure sensors may be coupled to the exterior of the vehicle body. As another example, the actuators may include fuel injector 66, isolation valve 110, purge valve 112, vent valve 114, fuel pump 21, and throttle 62.

Control system 14 may further receive information regarding the location of the vehicle from an on-board global positioning system (GPS). Information received from the GPS may include vehicle speed, vehicle altitude, vehicle position, etc. This information may be used to infer engine operating parameters, such as local barometric pressure. Control system 14 may further be configured to receive information via the internet or other communication networks. Information received from the GPS may be cross-referenced to information available via the internet to determine local weather conditions, local vehicle regulations, etc. Control system 14 may use the internet to obtain updated software modules which may be stored in non-transitory memory.

The control system 14 may include a controller 12. Controller 12 may be configured as a conventional microcomputer including a microprocessor unit, input/output ports, read-only memory, random access memory, keep alive memory, a controller area network (CAN) bus, etc. Controller 12 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines. Example control routines are described herein with regard to FIG. 3.

Controller 12 may also be configured to intermittently perform evaporative emissions diagnostic routines on fuel system 18 (e.g., fuel vapor recovery system). As such, various diagnostic evaporative emissions detection tests may be performed while the engine is off (engine-off evaporative emissions test) or while the engine is running (engine-on evaporative emissions test). Evaporative emissions tests performed while the engine is running may include applying a negative pressure on the fuel system for a duration (e.g., until a target fuel system vacuum is reached) and then sealing the fuel system while monitoring a change in fuel system pressure (e.g., a rate of change in the vacuum level, or a final pressure value). Evaporative emissions tests performed while the engine is not running may include sealing the fuel system following engine shut-off and monitoring a change in fuel system pressure. This type of evaporative emissions test is referred to herein as an engine-off natural vacuum test (EONV). In sealing the fuel system following engine shut-off, a vacuum will develop in the fuel system as the tank cools and fuel vapors are condensed to liquid fuel. The amount of vacuum and/or the rate of vacuum development may be compared to expected values that would occur for a system with no undesired vapor emissions, and/or for a system with undesired vapor emissions of a predetermined size. Following a vehicle-off event, as heat continues to be rejected from the engine into the fuel tank, the fuel system pressure will initially rise. During conditions of relatively high ambient temperature, a pressure build above a threshold may be considered a passing test. If pressure does not build above a threshold, vacuum generation may be monitored as the fuel system cools down and undesired vapor emissions may be identified based on expected vacuum development or expected rates of vacuum development.

Entry into an EONV evaporative emissions test may be based on a number of entry conditions, the entry conditions for the test generated from one or more sensors. For example, entry into an EONV evaporative emissions test may be based on one or more of at least ambient temperature, indicated by ambient temperature sensors, reid vapor pressure (RVP), air mass summation (AM), indicated by a mass air flow sensor, rain/humidity index, and fuel level (FLI), indicated by a fuel level sensor. One approach to enabling entry into an EONV evaporative emissions test includes setting thresholds for each entry condition, and enabling entry into the EONV evaporative emissions test given that all entry conditions pass their individual thresholds. In such an approach, the failure of one or more entry conditions may not enable entry into the EONV evaporative emissions test. Another approach for enabling entry into an EONV evaporative emissions test, as will be described in further detail below, includes evaluating each entry condition with one or more fuzzy membership functions, or with calibratable tables. For example, each entry condition may be evaluated using an "undesired emissions" fuzzy membership function, and an "absence of undesired vapor emissions" fuzzy membership function, and a confidence value may be thus determined for both an "undesired vapor emissions" outcome and an "absence of undesired vapor emissions" outcome for each entry condition. As the result of the EONV test is unknown prior to EONV test execution, the greater confidence value obtained from the two membership functions (MAX) represents an optimistic interpretation of the evaluation to enable EONV to execute without knowing the true state (undesired vapor emissions vs. absence of undesired vapor emissions) of the system. Following determining the MAX from each individual entry condition evaluation, another MAX operation may be performed wherein the MAX confidence value from all entry condition evaluations are compared, and the overall MAX confidence value is utilized in order to determine if the EONV test may execute. Such an approach optimizes opportunities for EONV test entry, enabling EONV tests more frequently, and may result in an increase in completion rates.

Subsequent to the completion of an EONV test, the result is known. In one approach, an Exponentially Weighted Moving Average (EWMA) with a fixed (constant) weight may be used to obtain a filtered output value based on the outcome of the EONV test defined by the equation:

$$Y(t)=(1-\alpha)*Y(t-1)+\alpha*X(t); \quad (1)$$

where Y is smoothed EONV output, X is current EONV output, and $\alpha$ is the weighting factor. In such an approach, when Y exceeds a predetermined threshold, a diagnostic trouble code (DTC) may be set to a fail status, and a malfunction indicator light (MIL) may be illuminated to indicate the fault. As described above, if each successful EONV test run is equally weighted, the EWMA filtered output may be misleading because the confidence for each EONV test run is not constant, yet the results are all treated with equal weighting through EWMA filtering. As such, as will be described in further detail below, another approach includes making the weighting factor ($\alpha$) variable according to the entry condition evaluations using the above described "undesired vapor emissions" and "absence of undesired vapor emissions" fuzzy membership functions. For example, after the EONV test result is known, the corresponding membership functions may be used to determine a confidence value for an indicated EONV test result, and this confidence value may be used to modify the weighting factor ($\alpha$). In one example, upon indication of undesired vapor emissions, the confidence value associated with each entry condition using the "undesired vapor emissions" membership function may be obtained, and the average of all confidence values (for all entry conditions) may be used to obtain an overall confidence value for the EONV test result, and this overall confidence value may be used to modify the weighting factor ($\alpha$) according to:

$$\alpha EWMA=CV\ pass\ or\ fail*\alpha default; \quad (2)$$

where $\alpha$default is a predetermined default weighting factor, CV (pass or fail) is the overall confidence value (average) for an indicated EONV test result obtained from membership functions corresponding to the indicated EONV test result, and $\alpha$EWMA is the modified weighting factor. As a second, more conservative approach, the overall confidence value may be obtained by similarly evaluating membership functions corresponding to the EONV test outcome for each individual entry condition such that confidence values for each entry condition are obtained, and then the overall minimum (MIN) value may be indicated as the overall confidence value and used to modify the weighting factor according to equation (2) above.

For example, FIG. 2A illustrates an ambient temperature entry condition. Current entry conditions for EONV allow for entry between 40° F. and 105° F., which is a compromise for "undesired vapor emissions" and "absence of undesired vapor emissions" outcomes, illustrated by arrow 210. However, as the confidence in a specific outcome of an EONV test is dependent on temperature, this information is not currently utilized. For example, an indicated undesired vapor emissions wherein temperature is high (e.g., 85° F.) may be considered a confident result because at high temperature pressure build-up tends to be high and thus the system is prone to falsely indicate an absence of undesired vapor emissions condition. As such, if undesired vapor emissions is indicated, there is high confidence the system has undesired vapor emissions. Similarly, an indicated absence of undesired vapor emissions condition wherein temperature is low (e.g., 50° F.) may be considered a confident result because at low temperatures pressure build-up is low and thus the system is prone to falsely indicate an undesired vapor emissions condition. As such, if a "absence of undesired vapor emissions" condition is indicated, there is high confidence the system does not contain undesired vapor emissions. Such information may be taken into account by evaluating entry conditions via the use of fuzzy membership functions (and/or calibratable tables). Illustrated in FIG. 2A are two such membership functions, an "undesired vapor emissions" membership function 206, and an "absence of undesired vapor emissions" membership function 208. Confidence values for each outcome may be assigned based on the indicated temperature. For example, at higher temperatures, confidence values increase for indication of undesired vapor emissions 206, while confidence values decrease for indication of an absence of undesired vapor emissions 208 condition. Alternatively, at lower temperatures, confidence values increase for an absence of undesired emissions 208 condition, while confidence values decrease for an undesired vapor emissions 206 condition.

FIG. 2B illustrates air mass summation as another example entry condition. Current entry conditions for EONV allow for entry between 4000 and 20000 (g/min), which is a compromise for "undesired vapor emissions" and "absence of undesired vapor emissions" outcomes, illustrated by arrow 230. As described above for the ambient temperature entry condition in FIG. 2A, the confidence in a specific outcome of an EONV test is dependent on the amount of air mass summation, and this information is not currently utilized. For example, when air mass summation is high, confidence in the test results is high when undesired vapor emissions is indicated because at high air mass summation pressure build-up tends to be high and thus the system is prone to falsely indicate an absence of undesired vapor emissions condition. As such, if undesired vapor emissions is indicated, there is high confidence the system has undesired vapor emissions. Similarly, an indicated absence of undesired vapor emissions condition wherein air mass summation is low may be considered a confident result because at low air mass summation pressure build-up tends to be low and thus the system is prone to falsely indicate an undesired vapor emissions condition. As such, if an "absence of undesired vapor emissions" condition is indicated, there is high confidence the system does not contain undesired vapor emissions. As described above with regard to FIG. 2A, such information may be taken into account by evaluating entry conditions via the use of fuzzy membership functions (and/or calibratable tables). Illustrated in FIG. 2B are two such membership functions, an "undesired vapor emissions" membership function 226 and an "absence of undesired vapor emissions" membership function 228. Confidence values for each outcome may be assigned based on the indicated amount of air mass summation. For example, at higher indicated levels of air mass summation, confidence values increase for indication of undesired vapor emissions 226, while confidence values decrease for indication of an absence of undesired vapor emissions 228 condition. Alternatively, at lower indicated levels of air mass summation, confidence values decrease for indication of undesired vapor emissions 226, while confidence values increase for indication of an absence of undesired vapor emissions 228 condition.

A further example entry condition comprising fuel level is illustrated in FIG. 2C. Current entry conditions for EONV allow for entry when the fuel tank is between 15% and 85% full, which is a compromise for "undesired vapor emissions" and "absence of undesired vapor emissions" outcomes illustrated by arrow 250. As described above for the ambient temperature (FIG. 2A) entry condition and the air mass summation (FIG. 2B) entry condition, the confidence in a specific outcome of an EONV test is dependent on the fuel level, and this information is not currently utilized. For example, when the fuel level is high (e.g., 85% of capacity), confidence in the test results is high when undesired vapor emissions is indicated because at high fuel levels pressure build-up tends to be high and thus the system is prone to falsely indicate an absence of undesired vapor emissions condition. Similarly, an indicated absence of undesired vapor emissions condition wherein fuel tank capacity is low (e.g., 15%) may be considered a confident result because at low fuel level pressure build-up tends to be low and thus the system is prone to falsely indicate an undesired vapor emissions condition. As described above in FIGS. 2A and 2B, such information may be taken into account by evaluating entry conditions via the use of fuzzy membership functions (and/or calibratable tables). Illustrated in FIG. 2C are two such membership functions, an "undesired vapor emissions" membership function 246 and an "absence of undesired vapor emissions" membership function 248. Confidence values for each outcome may be assigned based on the indicated fuel level. For example, at higher indicated fuel levels, confidence values increase for indication of undesired vapor emissions 246, while confidence values decrease for indication of an absence of undesired vapor emissions 248 condition. Alternatively, at lower indicated fuel levels, confidence values decrease for indication of undesired vapor emissions 246, while confidence values increase for indication of an absence of undesired vapor emissions 248 condition.

Similar rationale as that described above with regard to FIGS. 2A-2C may be applied to any number of entry conditions. As one example (not shown), fuzzy membership functions and/or calibratable tables for "undesired vapor emissions" and "absence of undesired vapor emissions" conditions may be utilized and confidence values assigned based on the indicated reid vapor pressure (RVP). As yet another example (not shown), fuzzy membership functions and/or calibratable tables may be utilized and confidence values assigned based on the indicated rain/humidity index.

As discussed briefly above, and as will be described in more detail below with regard to FIG. 3, each individual entry condition may be evaluated with the membership functions ("undesired vapor emissions" and "absence of undesired vapor emissions") in order to determine whether entry into an EONV test may be enabled. In order to optimize the frequency with which entry into EONV tests are enabled, the maximum (MAX) individual confidence value for each individual entry condition may be obtained, and a second MAX operation may be performed on the combined individual MAX confidence values in order to indicate the most optimistic interpretation of the entry condition evaluation in order to enable entry into the EONV test. Subsequent to completion of the EONV test at which point the result is known, the membership functions corresponding to the indicated outcome may be again used to obtain individual confidence values in the indicated EONV test result, and in one example averaging all the individual confidence values may be used to obtain a final overall confidence value for the test, which may then be used to modify the weighting factor, as described above. As an alternative, more conservative approach, the minimum (MIN) value of all the confidence values obtained subsequent to completion of the EONV test may be used as the final overall confidence value, and may be used to modify the weighting factor. In this way, output from the EWMA filter may reflect confidence in the test results, and as such a MIL may be more appropriately set as compared to conditions wherein filtered EONV output is not based on confidence in the obtained EONV test results.

FIG. 3 depicts a high-level method 300 for an engine-off natural vacuum test for a vehicle where an EWMA with a variable weighting factor is used to obtain a filtered output value for determining whether to set a malfunction indicator light (MIL). Method 300 will be described with relation to the system depicted in FIG. 1, but it should be understood that similar methods may be used with other systems without departing from the scope of this disclosure. Method 300 may be carried out by a controller, such as controller 12, and may be stored as executable instructions in non-transitory memory.

Method 300 begins at 302 and includes determining whether a vehicle-off event has occurred. The vehicle-off event may include an engine-off event, and may be indicated by other events, such as a key-off event. The vehicle-off event may follow a vehicle run time duration, the vehicle run time duration commencing at a previous vehicle-on event. If no vehicle-off event is detected, method 300 proceeds to 304. At 304, method 300 includes recording that an EONV test was not executed, and may further include setting a flag to retry the EONV test at the next detected vehicle-off event. Method 300 then ends.

If a vehicle-off event is detected, method 300 proceeds to 306. At 306, method 300 includes evaluating entry conditions. Evaluating entry conditions at 306 may include evaluating one or more of at least ambient temperature, air mass summation, fuel level, RVP, and rain/humidity index with one or more fuzzy membership functions (and/or calibratable tables), as described above with regard to FIGS. 2A-2C, in order to obtain initial individual confidence values, or a degree of confidence, for each of the individual entry conditions. In one example, ambient temperature, air mass summation, fuel level, RVP, and rain/humidity index may be individually analyzed by corresponding "undesired vapor emissions" and "absence of undesired vapor emissions" membership functions for each condition. Referring to FIG. 2A, for example, if ambient temperature is determined to be 85° F., the corresponding confidence value for an "undesired vapor emissions" outcome obtained by the corresponding "undesired vapor emissions" membership function (e.g., 206 in FIG. 2A) is determined to be ~0.9. Alternatively, at 85° F. the corresponding confidence value for an "absence of undesired vapor emissions" outcome obtained by the corresponding "absence of undesired vapor emissions" membership function (e.g., 208 in FIG. 2A) is determined to be ~0.4. As the result of the EONV test is currently unknown, in order to optimize the opportunities for enabling entry into the evaporative emissions test, the maximum (MAX) value obtained from evaluating the entry condition with the set of "undesired vapor emissions" and "absence of undesired vapor emissions" membership functions may be taken as the result for the entry condition evaluation. As such, the initial individual confidence value thus obtained for the ambient temperature entry condition evaluation in this example would be 0.9. As described, this value represents an optimistic initial individual confidence value such that opportunities for entry into EONV are optimized prior to knowing the true state (e.g., undesired vapor emissions or absence of undesired vapor emissions) of the system. In the same fashion, the above-described approach may be used to evaluate all of the other entry conditions at 306. As such, an optimistic initial individual confidence value for each entry condition may be obtained.

Following obtaining the initial individual confidence values, or individual degrees of confidence, for each entry condition evaluation, method 300 proceeds to 308 and includes performing a second MAX aggregation to obtain a first overall temporary confidence value, where the MAX initial individual confidence values obtained at 306 are further analyzed using a MAX aggregation operator such that the best case scenario from all entry conditions is utilized to enable entry into the EONV test. As such, by performing a second MAX aggregation to obtain a first overall temporary confidence value derived from initial individual confidence values, or a degree of confidence for each of the individual entry conditions, the most optimistic interpretation of the overall entry condition evaluation is used to determine entry into an EONV test.

Proceeding to 310, method 300 includes determining whether the overall temporary confidence value obtained at 308 is greater than a predetermined threshold. In some examples, it may instead be determined whether the overall temporary confidence value obtained at 308 is within a predetermined threshold range. If it is determined that the overall temporary confidence value is not above a predetermined threshold (or not within a predetermined range), method 300 proceeds to 312 and includes maintaining engine off parameters. For example, at 312 maintaining engine off parameters may include maintaining the canister vent valve open, and may further include setting a flag to indicate that entry to an EONV test was not enabled and that an EONV test may be attempted at the next detected vehicle-off event. Method 300 then ends.

If it is determined that the overall temporary confidence value is greater than a predetermined threshold (or within a predetermined range), method 300 proceeds to 314 and includes executing an EONV test monitor and obtaining the results of the EONV test. For example, at 314, executing an EONV test monitor may include commanding closed the canister vent valve in order to seal the fuel system from atmosphere, and monitoring a fuel system pressure rise for a duration with a fuel tank pressure sensor (e.g., 120 in FIG. 1). The EONV test may indicate a passing result (absence of undesired vapor emissions) if the pressure rise reaches a predetermined pressure threshold prior to plateauing, for example. Alternatively, if the pressure rise reaches a plateau without reaching the pressure threshold, the canister vent valve may be commanded open in order to allow the system to return to atmospheric pressure, whereupon the canister vent valve may again be commanded closed to seal the fuel system and the development of fuel system vacuum may be monitored for a duration. If a threshold level of vacuum is reached within a predetermined duration, a passing result (absence of undesired vapor emissions) may be indicated. Alternatively, if a threshold level of vacuum is not reached within a predetermined duration, undesired vapor emissions may be indicated.

Following indicating the presence of undesired vapor emissions or the absence of undesired vapor emissions in the fuel system, method 300 proceeds to 316 and includes evaluating all EONV entry conditions, or updating the degree of confidences for all EONV entry conditions, based on the obtained result from the EONV test. In one example, at 316 evaluating all EONV entry conditions based on the obtained EONV test result includes evaluating each entry condition with the fuzzy membership function (and/or calibratable table) corresponding to the obtained EONV test result. Returning to the example illustrated in FIG. 2A, if the ambient temperature was determined to be 85° F., and an "absence of undesired vapor emissions" was indicated by the results of the EONV test, the corresponding value obtained from the absence of undesired vapor emissions membership function is ~0.4. As described above, confidence in the indication of "absence of undesired vapor emissions" is not very high at 85° F. because at 85° F. pressure build-up tends to be high and thus the EONV test is prone to false "absence of undesired vapor emissions" indications. Alternatively, if the ambient temperature was determined to be 85° F., and "undesired vapor emissions" is indicated, the corresponding value obtained from the undesired vapor emissions membership function is ~0.9. Confidence in the indication of undesired vapor emissions is high at 85° F. because undesired vapor emissions indicated at 85° F. where pressure build-up is high and the system is prone to false "absence of undesired vapor emissions" indications is more likely to be the result of actual undesired vapor emissions. As such, at 316, method 300 thus includes evaluating all EONV entry conditions, or updating the degree of confidences for each entry condition, as described, to obtain a second individual confidence value for each entry condition that accurately reflects the EONV test outcome.

Proceeding to 318, method 300 includes obtaining a second final overall confidence value from the obtained second individual confidence values. In one example, obtaining a second final overall confidence value includes taking an average of all of the second individual confidence values. By taking an average of the second individual confidence values, an accurate representation of the overall confidence in the EONV test result may be obtained. In another example, a more conservative approach may be taken in order to obtain the final overall confidence value. In such an example, a minimum (MIN) aggregation may be performed on the set of second individual confidence values such that the final overall confidence value represents the most conservative value from the evaluation of all entry conditions with the individual fuzzy membership functions corresponding to the EONV test result.

Following obtaining the final overall confidence value at 318, method 300 proceeds to 320 and includes obtaining an updated weighting factor ($\alpha$). Obtaining an updated weighting factor at 320 includes multiplying a predetermined default update constant by the final overall confidence value obtained at 318, according to equation (2) illustrated above. As such, the weighting factor is variable and is based on the final overall confidence value in the obtained EONV test result. In one example, the predetermined default update constant may be 0.5. If the final overall confidence value is determined to be 0.8, the updated weighting factor thus becomes 0.4. In other examples, the predetermined default update constant may be any value between 0 and 1, and the obtained overall confidence value may additionally comprise any value between 0 and 1 that may be obtained by evaluating the fuzzy membership functions (and/or calibratable tables) for each entry condition corresponding to the outcome of the EONV test.

Proceeding to 322, method 300 includes obtaining filtered EONV output based on the variable weighting factor and EONV test results. Obtaining filtered EONV output based on the variable EWMA update constant at 322 includes substituting the updated weighting factor into equation (1) described above. Additionally, obtaining filtered EONV output at 322 includes substituting the current EONV output (e.g., "undesired vapor emissions" or "absence of undesired vapor emissions") into equation (1). As such, the filtered EONV output is a reflection of the indicated EONV result (undesired vapor emissions or absence of undesired vapor emissions), and the confidence in the indicated result, represented by the variable weighting factor ($\alpha$). Thus, for a given EONV result wherein a variable weighting factor is utilized to calculate a filtered EONV output, the greater the confidence in the result, the faster the EWMA update rate. Similarly, for a given EONV result, the lower the confidence in the result, the slower the EWMA update rate. In other words, a greater confidence in the EONV test result will change the filtered EONV output by a greater amount than a lower confidence result. This is in contrast to using a fixed weighting factor, where confidence in the EONV test result is not taken into account and thus the update rate is not correspondingly changed.

Continuing at 324, method 300 includes determining whether the filtered EONV output obtained at 322 is above a predetermined threshold. If the filtered EONV output is not above a threshold, method 300 proceeds to 326 and includes updating vehicle system parameters. At 326, updating vehicle system parameters may include indicating the successful completion of an EONV test, and recording the results. For example, undesired vapor emissions may have been indicated, yet the confidence in the result was low, thus the filtered EONV output remained below the threshold at 324 and a MIL was not set. However, as undesired vapor emissions was indicated but a MIL was not set, an evaporative emissions test schedule may be updated to indicate further testing. Method 300 may then end. In one example, in 326, the routine may further include adjusting engine operation responsive to determining undesired vapor emissions have been indicated. For example, the routine may attempt to close fuel system valves to seal the fuel system during selected engine operating conditions. As another example, the routine may adjust scheduling of fuel vapor purging to increase fuel vapor purging durations in an attempt to clean stored fuel vapors at a higher rate to compensate for the increase in undesired emissions. The increased fuel vapor purging may include reducing adaptive learning operation durations and increasing available engine operation durations for fuel vapor purging.

Returning to 324, if the filtered EONV output is indicated to be above a predetermined threshold, method 300 proceeds to 328 and includes setting a MIL. In such an example, wherein the filtered EONV output is based on a calculated level of confidence in the obtained EONV test result, opportunities for the MIL to be wrongly set are reduced. Proceeding to 326, method 300 includes updating vehicle system parameters to include the indication of undesired fuel system vapor emissions. For example, a canister purge schedule may be updated as a result of the indicated undesired vapor emissions such that a purge is initiated more frequently in order to clear vapors from the fuel system. In another example, a canister vent valve may be maintained closed in an effort to reduce the routing of vapors from the fuel tank to the vapor canister. Method 300 may then end.

In some examples, method 300 for an engine-off natural vacuum test for a vehicle may be enabled after shut-off of the engine and may further comprise running the test more than one time after the engine shut-off, wherein for each subsequent test the fuel system may be first brought back to atmospheric pressure and then sealed for a predetermined time before running the subsequent test.

FIG. 4 shows an example timeline 400 for an EONV test on a fuel system with an absence of undesired emissions where the outcome of the EONV indicates undesired vapor emissions but a MIL is correctly not set due to calculating a filtered EONV output via the use of a variable weighting factor. If a variable weighting factor is not utilized, a MIL may be falsely set. Timeline 400 includes plot 405, indicating a vehicle-on status over time, plot 410, indicating a canister vent valve over time, and plot 415, indicating a fuel system pressure over time. Line 416 represents a pressure threshold for the pressure rise portion of an EONV test. Line 417 represents a vacuum threshold for the vacuum portion of an EONV test. Timeline 400 further includes plot 420, indicating whether undesired vapor emissions is indicated, and plot 425, indicating whether a MIL has been set, over time. Line 426 represents whether a MIL has been set, if a fixed (rather than variable) weighting factor is utilized to calculate the filtered EONV output. Timeline 400 further includes plot 430, indicating the final confidence value in the result obtained from the EONV test, which is utilized to modify the variable weighting factor, and plot 435, indicating the resulting filtered EONV output, over time. Line 436 represents a threshold value wherein above the threshold a MIL is set, and wherein below the threshold a MIL is not set. Timeline 400 further includes line 437, indicating a filtered EONV output value obtained if a fixed (rather than variable) weighting factor is utilized.

At time $t_0$, the vehicle is on, as indicated by plot 405. Accordingly, the canister vent valve is open, as indicated by plot 410. At time $t_1$, the vehicle is turned off. Between time $t_1$ and $t_2$, entry conditions are evaluated. For example, entry conditions evaluated may include air mass summation, ambient temperature, fuel level, rain/humidity index, and reid vapor pressure. As described above with regard to the method illustrated in FIG. 3, each individual entry condition may be evaluated with membership functions and/or calibratable tables ("undesired vapor emissions" and "absence of undesired vapor emissions"), and the MAX individual confidence value for each individual entry condition may be obtained. A second MAX operation may then be performed in order to obtain an overall temporary confidence value. If the overall temporary confidence value is above a predetermined threshold, or within a predetermined threshold range, entry into the EONV test may be enabled. In example timeline 400, entry into the EONV test is enabled, thus at time $t_2$, the canister vent valve is closed, and the fuel system pressure increases, as indicated by plot 415. Between time $t_2$ and $t_3$ however, fuel system pressure reaches a plateau and does not reach the threshold. As such, at time $t_3$, the canister vent valve is opened, allowing the fuel system pressure to return to atmospheric pressure, but no undesired vapor emissions is indicated, as indicated by plot 420, and a MIL is not set, indicated by plot 425.

At time $t_4$, the fuel system pressure has returned to atmospheric pressure. The canister vent valve is then closed. As heat continues to dissipate from the fuel system, a vacuum develops in the fuel system. However, the test time limit is reached at time $t_5$, prior to the fuel system vacuum reaching the vacuum threshold represented by line 417. Accordingly, undesired vapor emissions is indicated, and the canister vent valve is opened. As undesired vapor emissions is indicated, between time $t_5$ and $t_6$ the corresponding undesired vapor emissions membership functions for each entry condition are analyzed, as described above with regard to the method illustrated in FIG. 3, in order to determine an overall degree of confidence for the obtained result. In one example, a second individual confidence value for each entry condition is obtained based on the undesired vapor emissions membership function, and an average of the obtained second confidence values is used to obtain a final overall confidence value, indicated by plot 430. As described above, in another example, a more conservative approach may be taken wherein a minimum (MIN) aggregation may be performed on the set of second individual confidence values such that the final overall confidence value represents the most conservative value from the evaluation of all entry conditions with the individual undesired vapor emissions membership functions. The final confidence value thus obtained is then used to obtain an updated weighting factor which is then used in accordance with equation (1) described above in order to obtain a filtered EONV output value, indicated by plot 435. At time $t_6$, although undesired vapor emissions is indicated, confidence in the result is low, indicated by plot 430, and thus the filtered EONV output value, indicated by plot 435, is below a threshold for setting the MIL. In this way, use of a variable weighting factor prevented falsely triggering the MIL light responsive to the indicated undesired vapor emissions because confidence in the undesired vapor emissions determination was low. However, if a variable weighting factor had not been utilized, and instead a fixed weighting factor had been used, a MIL would have been falsely set, indicated by line 426, as the filtered EONV output value, indicated by line 437 would have crossed the threshold.

Turning now to FIG. 5, an example timeline 500 is shown for an EONV test on a fuel system with undesired vapor emissions wherein undesired vapor emissions is indicated and a MIL is correctly set based on a variable weighting factor. If a variable weighting factor were not utilized, a MIL may be incorrectly not set. Timeline 500 includes plot 505, indicating a vehicle-on status over time, plot 510, indicating a canister vent valve status over time, and plot 515, indicating a fuel system pressure over time. Line 516 represents a pressure threshold for the pressure rise portion of an EONV test. Line 517 represents a vacuum threshold for the vacuum portion of an EONV test. Timeline 500 further includes plot 520, indicating whether undesired vapor emissions is indicated, and plot 525, indicating whether a MIL is set, over time. Line 526 represents whether a MIL has been set, if a fixed (rather than variable) weighting factor is utilized. Timeline 500 further includes plot 530, indicating the final confidence value in the result obtained from the EONV test, which is utilized to modify the variable weighting factor, and plot 535, indicating the resulting filtered EONV output, over time. Line 536 represents a threshold value wherein above the threshold a MIL is set, and wherein below the threshold a MIL is not set. Timeline 500 further includes line 537, indicating a filtered EONV output value obtained if a fixed (rather than variable) weighting factor is utilized.

At time $t_0$, the vehicle is on, as indicated by plot 505. Accordingly, the canister vent valve is open, as indicated by plot 510. At time $t_1$, the vehicle is turned off. Between time $t_1$ and $t_2$, entry conditions are evaluated as described above for FIG. 4. In this example 500, entry into the EONV test is enabled, thus at time $t_2$, the canister vent valve is closed, and the fuel system pressure increases, as indicated by plot 515. Between time $t_2$ and $t_3$ however, fuel system pressure reaches a plateau and does not reach the threshold. As such, at time $t_3$, the canister vent valve is opened, allowing the fuel system pressure to return to atmospheric pressure, but no undesired vapor emissions is indicated, as indicated by plot 520, and a MIL is not set, indicated by plot 525.

At time $t_4$, the fuel system pressure has returned to atmospheric pressure. The canister vent valve is then closed. As heat continues to dissipate from the fuel system, a vacuum develops in the fuel system. However, the test time limit is reached at time $t_5$, prior to the fuel system vacuum reaching the vacuum threshold represented by line 517. Accordingly, undesired vapor emissions is indicated, and the canister vent valve is opened. As undesired vapor emissions is indicated, between time $t_5$ and $t_6$ the corresponding undesired vapor emissions membership functions and/or calibratable tables for each entry condition are analyzed in order to determine an overall degree of confidence for the obtained result. As described above with regard to FIG. 4, in one example, a second individual confidence value for each entry condition may be obtained based on the undesired vapor emissions membership function, and an average of the obtained second individual confidence values is used to obtain a final overall confidence value, indicated by plot 530. Alternatively, in another example, a more conservative approach may be taken wherein a minimum (MIN) aggregation may be performed on the set of second individual confidence values such that the final overall confidence value represents the most conservative value from the evaluation of all entry conditions with the individual undesired vapor emissions membership functions. The final confidence value thus obtained is then used to obtain an updated weighting factor which is then used in accordance with equation (1) described above in order to obtain a filtered EONV output value. At time $t_6$, undesired vapor emissions is indicated and confidence in the result is high, indicated by plot 530, and thus the filtered EONV output value, indicated by plot 535, is above a threshold for setting the MIL. As such, use of a variable weighting factor correctly triggered the MIL light responsive to the indicated undesired vapor emissions because confidence in the undesired vapor emissions determination was high. However, if a variable weighting factor had not been utilized, and instead a fixed weighting factor was used, a MIL would have been incorrectly not set, indicated by line 526, as the filtered EONV output value, indicated by line 537 would not have been above the threshold.

In this way, filtered EONV output may be generated based on determined confidence levels in EONV test results, such that test results where the confidence is high are more heavily weighted and alternatively test results where the confidence is low are weighted less heavily. As such, the false triggering of a MIL in the absence of undesired vapor emissions may be reduced, and the early triggering of a MIL when undesired vapor emissions are confidently ascertained, may be increased. The technical effect of filtering EONV output based on determined confidence levels in EONV test results is to evaluate individual entry conditions for the EONV test with one or more fuzzy membership functions and/or calibratable tables and subsequent to the results of the EONV test being known, determining an overall confidence factor in the obtained result based on the membership functions (and/or tables) for each entry condition corresponding to the obtained result. As such, the overall confidence in the obtained result may be used to modify a weighting factor such that the filtered output is based on the level of confidence in the EONV test result.

The systems described herein and with reference to FIG. 1, along with the methods described herein and with reference to FIG. 3 may enable one or more systems and one or more methods. In one example, a method comprises, inducting vapors from a fuel system into an engine; conducting a test for undesired vapor emissions from the fuel system after the vapor inducting is stopped; generating a final overall confidence value in a result of the test based on one or more engine operating conditions; generating a weighting factor from the final overall confidence value; and applying the weighting factor to the test result to indicate undesired emissions. In a first example of the method, the method includes wherein the test is commenced when a first temporary overall confidence value, derived from a degree of confidence in the one or more engine operating conditions, exceeds a threshold, the degree of confidence based on one or more predicted test outcomes. A second example of the method optionally includes the first example and further includes wherein the test is commenced after shut-off of the engine. A third example of the method optionally includes one or more of the first and second examples and further includes wherein the test comprises sealing the fuel system and monitoring vapor pressure in the fuel system. A fourth example of the method optionally includes any one or more or each of the first through third examples and further includes wherein the operating conditions comprise one or more of the following: engine run-time, integrated mass air flow, fuel level, ambient temperature, and reid vapor pressure. A fifth example of the method optionally includes any one or more or each of the first through fourth examples and further includes wherein the test is enabled after shut-off of the engine and further comprises running the test more than one time after the engine shut-off, for each subsequent test the fuel system is first brought back to atmospheric pressure and then sealed for a predetermined time before running the subsequent test.

Another example of a method comprises inducting vapors from a fuel system into an engine; generating a degree of confidence for each of a plurality of test entry conditions that a test for undesired vapor emissions will achieve a reliable result; after shut-down of the engine, commencing the test based on a first temporary overall confidence value related to the degree of confidences; generating a test result based on pressure of the fuel system during the test; updating the degree of confidences based on the test result and generating a final overall confidence value based on the updates; and indicating whether undesired emissions are present based on the final overall confidence value and the test result. In a first example of the method, the method includes wherein the test is commenced when the first temporary overall confidence value derived from the degree of confidences exceeds a threshold. A second example of the method optionally includes the first example and further includes wherein the entry conditions are based on an inferred total amount of heat rejected into the fuel tank during the prior drive cycle and the inferred amount of heat may be based on one or more of the following: engine run-time, integrated mass air flow, fuel level, ambient temperature, and reid vapor pressure.

Another example of a method comprises inducting vapors from a fuel system into an engine which propels a motor vehicle; responsive to an engine shut-off event, enabling an on-board vehicle test for undesired vapor emissions from the fuel system; generating one or more entry conditions for the test from one or more sensors; indicating one or more confidence values in one or more predicted results of an onboard vehicle test for each of the one or more entry conditions; indicating a first temporary overall confidence value based on a maximum of the one or more confidence values for each of the one or more entry conditions; responsive to completion of the onboard vehicle test where an actual result is indicated, generating a second final overall confidence value in the indicated actual result; and modifying the test result based in part on the second final overall confidence value to determine whether there are undesired vapor emissions. In a first example of the method, the method includes wherein the one or more sensors include one or more of a mass air flow sensor, a fuel level sensor, an ambient temperature sensor. A second example of the method optionally includes the first example and further includes wherein the one or more predicted results include an undesired vapor emissions outcome, and an absence of undesired vapor emissions outcome. A third example of the method optionally includes one or more of the first and second examples and further includes wherein the one or more confidence values is determined based on a predetermined calibratable table and/or a fuzzy membership function for the predicted results. A fourth example of the method optionally includes any one or more or each of the first through third examples and further comprising indicating whether the first overall confidence value in one or more predicted results is above a predetermined threshold, or within a predetermined threshold range. A fifth example of the method optionally includes any one or more or each of the first through fourth examples and further includes wherein entry into the onboard vehicle test is enabled responsive to the first temporary overall confidence value above the predetermined threshold, or within the predetermined threshold range. A sixth example of the method optionally includes any one or more or each of the first through fifth examples and further includes wherein the second final overall confidence value is determined based on the predetermined calibratable tables and/or the fuzzy membership functions corresponding to the actual results. A seventh example of the method optionally includes any one or more or each of the first through sixth examples and further includes wherein the second final overall confidence value is used to modify a weighting factor. An eighth example of the method optionally includes any one or more or each of the first through seventh examples and further includes wherein the weighting factor is used to modify the actual results by filtering the actual results to obtain a test output. A ninth example of the method optionally includes any one or more or each of the first through eighth examples and further includes wherein the filter is an exponentially weighted moving average (EWMA) filter. A tenth example of the method optionally includes any one or more or each of the first through ninth examples and further includes wherein the onboard vehicle test is an engine-off natural vacuum (EONV) evaporative emissions test.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

inducting vapors from a fuel system into an engine;

conducting a test for undesired vapor emissions from the fuel system after the vapor inducting is stopped;

generating a final overall confidence value in a result of the test for undesired vapor emissions based on one or more engine operating conditions, the final overall confidence value being an average of a plurality of confidence levels that indicate an outcome for the test, the plurality of confidence levels being responsive to test entry conditions;

generating a weighting factor from the final overall confidence value;

applying the weighting factor to the result to indicate undesired emissions; and indicating undesired emissions by an indicator display.

2. The method recited in claim 1, wherein a first temporary overall confidence value that is derived from a degree of confidence in the one or more engine operating conditions is required to exceed a threshold to commence the test for undesired vapor emissions, the degree of confidence based on one or more predicted test outcomes.

3. The method recited in claim 2, wherein the test for undesired vapor emissions is commenced after shut-off of the engine.

4. The method recited in claim 1, wherein the test for undesired vapor emissions comprises sealing the fuel system and monitoring vapor pressure in the fuel system.

5. The method recited in claim 1, wherein the operating conditions comprise one or more of the following: engine run-time, integrated mass air flow, fuel level, ambient temperature, and reid vapor pressure.

6. The method recited in claim 4, wherein the test for undesired vapor emissions is enabled after shut-off of the engine and further comprises running the test for undesired vapor emissions more than one time after the engine shut-off, for each subsequent test for undesired vapor emissions the fuel system is first brought back to atmospheric pressure and then sealed for a predetermined time before running the subsequent test for undesired vapor emissions, the method further comprising adjusting engine operation responsive to the indication of undesired emissions.

7. A method comprising:

inducting vapors from a fuel system into an engine;

generating a numerical degree of confidence for each of a plurality of test entry conditions that a test for undesired vapor emissions will achieve a reliable result;

after shut-down of the engine, commencing the test for undesired vapor emissions based on a first temporary overall confidence value related to the degrees of confidence exceeding a threshold;

generating a test result based on pressure of the fuel system during the test for undesired vapor emissions;

updating the degrees of confidence based on the test result and generating a final overall confidence value based on the updates, the final overall confidence value being an average of a plurality of confidence levels that indicate an outcome for the test, the plurality of confidence levels being responsive to the test entry conditions;

indicating whether undesired emissions are present based on the final overall confidence value and the test result; and indicating undesired emissions by an indicator display.

8. The method recited in claim 7, wherein the plurality of test entry conditions is based on an inferred total amount of heat rejected into a fuel tank during a prior drive cycle and the inferred total amount of heat rejected into the fuel tank may be based on one or more of the following: engine run-time, integrated mass air flow, fuel level, ambient temperature, and reid vapor pressure.

9. A method comprising:

inducting vapors from a fuel system into an engine, the engine propelling a motor vehicle;

responsive to an engine shut-off event, enabling an on-board vehicle test for undesired vapor emissions from the fuel system;

generating one or more entry conditions for the on-board vehicle test for undesired vapor emissions from one or more sensors;

indicating one or more numerical confidence values in one or more predicted results of the on-board vehicle test for undesired vapor emissions for each of the one or more entry conditions;

indicating a first temporary overall confidence value based on a maximum of the one or more confidence values for each of the one or more entry conditions;

responsive to completion of the on-board vehicle test undesired vapor emissions where an actual result is indicated, generating a second final overall confidence value in the indicated actual result, the second final overall confidence value being an average of a plurality of confidence levels that indicate an outcome for the test, the plurality of confidence levels being responsive to test entry conditions;

modifying the actual result based in part on the second final overall confidence value to determine whether there are undesired vapor emissions; and indicating undesired emissions by an indicator display.

10. The method recited in claim 9, wherein the one or more sensors include one or more of a mass air flow sensor, a fuel level sensor, and an ambient temperature sensor.

11. The method recited in claim 9, wherein the one or more predicted results include an undesired vapor emissions outcome and an absence of an undesired vapor emissions outcome.

12. The method recited in claim 9, wherein the one or more confidence values is determined based on a predetermined calibratable table or a fuzzy membership function for the one or more predicted results.

13. The method recited in claim 9, further comprising indicating whether the first overall confidence value in the one or more predicted results is above a predetermined threshold or within a predetermined threshold range.

14. The method recited in claim 13, wherein entry into the on-board vehicle test for undesired vapor emissions is enabled responsive to the first temporary overall confidence value above the predetermined threshold or within the predetermined threshold range.

15. The method recited in claim 9, wherein the second final overall confidence value is determined based on predetermined calibratable tables or fuzzy membership functions corresponding to the actual result.

16. The method recited in claim 9, wherein the second final overall confidence value is used to modify a weighting factor.

17. The method recited in claim 16, wherein the weighting factor is used to modify the actual result by filtering the actual result to obtain a test output.

18. The method recited in claim 17, wherein a filter is an exponentially weighted moving average (EWMA) filter.

19. The method recited in claim 9, wherein the on-board vehicle test for undesired vapor emissions is an engine-off natural vacuum (EONV) evaporative emissions test.

* * * * *